United States Patent [19]

Simoyama et al.

[11] Patent Number: 4,961,690

[45] Date of Patent: Oct. 9, 1990

[54] VARIABLE DISPLACEMENT TYPE COMPRESSOR

[75] Inventors: Yoshirou Simoyama; Toyohei Nakajima; Nobuyuki Tanaka; Tetsuya Miyake, all of Wako, Japan

[73] Assignee: Honda Giken Kogyo Kabushiki Kaisha, Tokyo, Japan

[21] Appl. No.: 382,940

[22] Filed: Jul. 21, 1989

[30] Foreign Application Priority Data

Aug. 2, 1988 [JP] Japan ..... 63-102598[U]

[51] Int. Cl.[5] ..... F04B 1/26

[52] U.S. Cl. ..... 417/222; 417/270; 91/506

[58] Field of Search ..... 417/222, 222 S, 270; 91/506

[56] References Cited

U.S. PATENT DOCUMENTS

| | | | |
|---|---|---|---|
| 4,150,370 | 8/1978 | Brucken et al. | 417/222 |
| 4,297,085 | 10/1981 | Brucken | 417/222 |
| 4,487,109 | 12/1984 | Burandt et al. | 417/222 |
| 4,737,079 | 4/1988 | Kurosawa | 417/222 |
| 4,822,252 | 4/1989 | Ishikawa et al. | 417/222.5 |
| 4,886,423 | 12/1989 | Iwanami et al. | 417/222.5 |

FOREIGN PATENT DOCUMENTS

| | | |
|---|---|---|
| 2911482 | 10/1979 | Fed. Rep. of Germany . |
| 3500299A1 | 11/1985 | Fed. Rep. of Germany . |

OTHER PUBLICATIONS

Industrellen Messtechnik.

*Primary Examiner*—Leonard E. Smith
*Assistant Examiner*—John A. Savio, III
*Attorney, Agent, or Firm*—Armstrong, Nikaido, Marmelstein, Kubovcik & Murray

[57] ABSTRACT

A variable displacement type compressor includes a casing having a working chamber and cylinder bores provided therein and opened to face to the working chamber. The cylinder bores are disposed around a driving shaft rotatably carried in the casing. A working piston is slidably received in each of the cylinder bores. A sleeve is axially slidably fitted over the driving shaft within the working chamber and carries a holder mounted for swinging movement about an axis perpendicular to an axis of the driving shaft and connected to the driving shaft. A swingable swash plate is carried on the holder and connected by rods to the working pistons. A control piston is connected to the sleeve and slidably received in the casing to vary the angle of inclination of the holder and the swingable swash plate and vary the stroke of the working pistons. A stroke detecting device detects the operation stroke of the working pistons and includes an interlocking member supported at a middle portion on the casing by a shaft having an axis perpendicular to the axis of the driving shaft and connected at opposite ends to the control piston and a position detector disposed on the casing. The control piston can be relatively rotatably connected to the sleeve to inhibit transmission of rotating movement of the sleeve. The position detector is disposed outside the casing.

3 Claims, 2 Drawing Sheets

VARIABLE DISPLACEMENT TYPE COMPRESSOR

BACKGROUND

The present invention relates to a variable displacement type compressor and, more particularly, such a compressor comprising a casing having a working chamber internally defined therein and a plurality of cylinder bores provided therein opened to face to the working chamber. A driving shaft is rotatably carried in the casing with the cylinder bores axially aligned with and disposed around the driving shaft. A working piston is slidably received in each of the cylinder bores. A sleeve is axially slidably fitted over the driving shaft within the working chamber. A holder is carried on the sleeve for swinging movement about an axis perpendicular to an axis of the driving shaft and is connected to the driving shaft. A swingable swash plate is carried on the holder and is connected to the working pistons through connecting rods. A control piston is connected to the sleeve and slidably received in the casing so as to vary the angle of inclination of the holder and the swingable swash plate to vary the operation stroke of the working pistons. Stroke detecting means is provided for detecting the operation stroke of the working pistons.

A variable displacement type compressor is known, for example, from Japanese Patent Application Laid-open No. 218670/87 or the like, in which the operation stroke of the working pistons is varied by controlling the angle of inclination of a swash plate swingable about an axis perpendicular to an axis of a driving shaft, and with the variation of the operation stroke, the discharge amount is varied.

In such compressor, however, it is necessary to detect the operation stroke of the working pistons for the purpose of controlling the operation stroke of the working pistons and detecting any trouble. In the above compressor, a position detector is provided in the casing, which generates an electric pulse signal whenever an object to be detected, provided on the swingable swash plate passes through sensing range of the position detector. In such a position detector for detecting the operation stroke by detection of the swinging motion of the swingable swash plate, however, the detection of the stroke is possible only when the swingable swash plate is swung. The operation stroke cannot be detected before starting of the operation of the compressor. For this reason, when the operation of the compressor is started in a region of slow speed (lower revolutions) of an engine connected to the driving shaft (e.g., during idling), it is not obvious that the number of revolutions of the engine should be set at what level and in addition, it is impossible to set the amount of fuel supplied to the engine sufficient to maintain the number of revolutions.

The present invention has been accomplished with such circumstances in view, and it is an object of the present invention to provide a variable displacement type compressor wherein the stroke of the working pistons can be detected even before starting of the operation of the compressor.

SUMMARY OF THE INVENTION

A first feature of the invention resides in a variable displacement type compressor comprising a casing having a working chamber internally defined therein and a plurality of cylinder bores provided therein opened to face to the working chamber, driving shaft rotatably carried in the casing with the cylinder bores disposed around the driving shaft, a working piston slidably received in each of the cylinder bores, a sleeve axially slidably fitted over the driving shaft within the working chamber, a holder carried on the sleeve for swinging movement about an axis perpendicular to an axis of the driving shaft and connected to the driving shaft, a swingable swash plate carried on the holder and connected to the working pistons through connecting rods, a control piston connected to the sleeve and slidably received in the casing so as to vary the angle of inclination of the holder and the swingable swash plate to vary the operation stroke of the working pistons, and stroke detecting means for detecting the operation stroke of the working pistons, wherein the stroke detecting means comprises an interlocking member supported at its middle portion on the casing through a support shaft having an axis perpendicular to the axis of the driving shaft and connected at one end thereof to the control piston, and a position detector disposed on the casing to detect the position of the other end of the interlocking member.

In addition, a second feature of the present invention resides in that the control piston is relatively rotatably connected to the sleeve to inhibit the transmission of the rotating movement of the sleeve about the axis of the driving shaft.

Further, a third feature of the present invention resides in that the position detector is disposed outside the casing.

According to the first feature, the position of the other end of the interlocking member connected at one end thereof to the control piston is determined depending upon the operation stroke of the working pistons, i.e., the position of the control piston along the axis of the driving shaft. Hence, the operation stroke of the working pistons may be detected by detecting the position of the other end of the interlocking member by the position detector. Therefore, it is possible to detect the operations stroke even before starting of the operation of the compressor. For the other end of the interlocking member to be detected by the position detector, it is desirable in improving the detection accuracy that such other end is largely displaced as compared with the axial displacement of the control piston, on the one hand, and it is desirable in the layout of the detector that the amount of such displacement is smaller, on the other hand. Thus, it is possible to provide a design with these conflicting demands satisfied by selection of the position at which the support shaft of the interlocking member is disposed.

According to the second feature, the rotational movement of the sleeve is inhibited from being transmitted to the control piston and therefore, a force in the rotational direction being applied to the interlocking member is avoided.

Further, according to the third feature, it is possible to replace and repair the parts of the position detector without opening of the interior of the casing.

BRIEF DESCRIPTION OF THE DRAWINGS

The above and other objects and the attendant advantages of the present invention will become readily apparent by reference to the following detailed description when considered in conjunction with the accompanying drawings wherein:

FIGS. 1 and 2 illustrate one embodiment of the present invention, wherein

FIG. 1 is a side view in longitudinal section of an essential portion of a variable displacement type compressor; and FIG. 2 is a front view of an interlocking member.

DETAILED DESCRIPTION OF PREFERRED EMBODIMENTS

Figure 1:
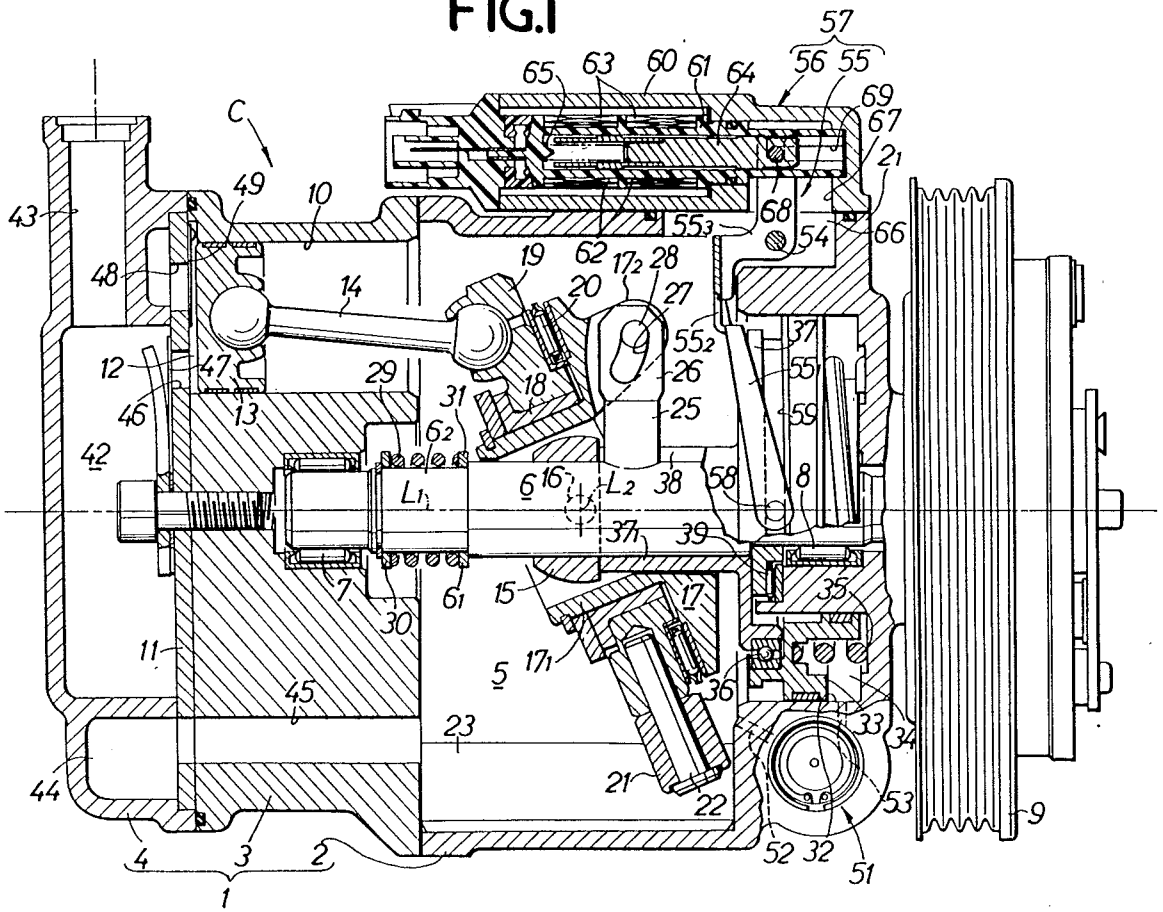

The present invention will now be described by way of embodiments with reference to the accompanying drawings. Referring first to FIG. 1 illustrating one embodiment of the present invention, a variable displacement type compressor C is used for compression of a refrigerant gas, for example, in an air conditioner for a vehicle. A casing 1 for the compressor C is comprised of a bottomed basically cylindrical casing body 2, a cylinder block 3 secured to an opened end face of the casing body 2, and a cylinder head 4 superposed on an end face of the cylinder block 3, which components are integrally connected. A working chamber 5 is defined in the casing 1 by the casing body 2 and the cylinder block 3.

A driving shaft 6 is rotatably carried on the cylinder block 3 in the casing 1 and on a closed end wall $2_1$ of the casing body 2 with radial needle bearings 7 and 8 interposed therebetween, respectively. The axis of the driving shaft 6 lies on an axis L1 of the casing 1. A drive pulley 9 with a clutch therein is integrally connected to a projecting end of the driving shaft 6 projecting from the closed end wall $2_1$ of the casing 1. The drive pulley 9 is operatively connected to a drive source such as an engine which is not shown, so that it may be rotatively driven by a driving power from the engine.

The cylinder block 3 has a plurality of cylinder bores 10 provided therein in parallel to the driving shaft 6. Each bore 10 is opened at one end into the working chamber 5. These cylinder bores 10 are disposed at distances equally spaced apart on a concentric circle about the axis L1. An end plate 11 is clamped between the cylinder head 4 and the cylinder block 3 to close the other end of each of the cylinder bores 10. A working piston 13 is slidably received in each cylinder bore 10 to define a pressure chamber 12 between it and the end plate 11. One spherical end of a connecting rod 14 is rotatably connected to a back of each of the working pistons 13 on the side of the working chamber 5, and the other spherical end of each of the connecting rods 14 reaches the inside of the working chamber 5 and is connected to a swingable swash plate 19 which will be described hereinafter.

In the working chamber 5, a sleeve 15 is slidably fitted over the driving shaft 6. A pair of left and right pivots 16 are integrally provided on the outer surface of the sleeve in projection on lateral opposite sides of the sleeve 15 with each having a center on an axis L2 perpendicular to the axis L1 of the driving shaft 6 (normal to the sheet surface of FIG. 1) A board-like holder 17 is carried on the left and right pivots 16 for swinging movement back and forth along the axis of driving shaft 6. The swingable swash plate 19 is rotatably carried on a cylindrical portion 171 of the holder 17 extending to surround the sleeve 15. A radial bearing 18 is interposed between the cylindrical portion and the swash plate. A needle thrust bearing 20 is interposed between opposed surfaces of the swingable swash plate 19 and the holder 17. A detent member 21 is connected to an outer end of the swingable swash plate 19 by a connecting pin 22. A guide groove 23 is provided in an inner surface of the casing body 2 extending in parallel to the driving shaft 6 between the cylinder block 3 and the end wall 21 of the casing body within the working chamber 5. The detent member 21 is slidably engaged in the guide groove 23. The guide groove 23 and the detent member 21 prevent the swingable swash plate 19 from rotating about the axis L1.

The driving shaft 6 is integrally provided with a drive pin 25 projecting therefrom and having a radially extending axis. The drive pin 25 has a connecting arm 26 integrally provided on its leading end and having an arcuate hole 27 in which is slidably engaged an pin 28 which is integrally provided on a mounting piece $17_2$ of the holder 17 to project therefrom. The arcuate hole 27 permits the swinging movement of the swingable swash plate 19 about the pivots 16 within an extent of its length, and the holder 17 is rotated in response to rotation of the driving shaft 6.

The spherical ends of the connecting rods 14 connected to the working pistons 13 are rotatably connected to one surface of the swingable swash plate 19, as described above. Therefore, the operation stroke, i.e., the discharge amount of the working piston 13 in the cylinder bore 10 is determined depending upon the angular displacement of the swingable swash plate 19 about of the axis L2 of the pivots 16 relative to the axis L1.

The driving shaft 6 is formed, at its end closer to the cylinder block 3, with a smaller diameter shaft portion $6_2$ through a stepped portion $6_1$. A coiled compression spring 29 is wound around the smaller diameter shaft portion $6_2$. The coiled compression spring 29 is engaged at one end thereof with a spring seat 30 fitted and locked over the smaller diameter shaft portion $6_2$, and at the other end thereof with an annular stopper 31 locked over the stepped portion $6_1$. The stopper 31 functions to engage one end face of the sleeve 15 to compress the coiled compression spring 29, when the sleeve 15 slides leftwardly as viewed in FIG. 1.

An annular bottomed slide bore 32 opened toward the working chamber 5 is centrally provided in the end wall $21_1$ of the casing 2 in a concentric relation to the driving shaft 6. An annular control piston 33 is slidably received in the slide bore 32. A control pressure chamber 34 is defined between the control piston 33 and a closed end of the slide bore 32. A coiled compression coiled spring 35 is contained in the control pressure chamber 34 biasing the control piston 33 toward the working chamber 5.

The control piston 33 is rotatably carried at its end closer to the working chamber 5 on a control plate 37 with angular ball bearing 36 interposed therebetween. The control plate 37 is integrally provided with a cylindrical portion $37_1$ which axially extends to surround the driving shaft 6 and has its end face engaged with an end face of the sleeve 15 by a repulsive force of the coiled compression spring 35. The cylindrical portion $37_1$ also has an axially extending slit 38 made therein. The drive pin 25 extends through the slit 38, and the control plate 37 is rotated in unison with the driving shaft 6 while permitting the axial movement of the control plate 37.

A thrust needle bearing 39 is interposed between a back of the control plate 37 and the end wall $2_1$ of the casing body 2. If the control piston 33 slides leftwardly or rightwardly, the sleeve 15 axially moves following the control piston 33, and correspondingly, the angular displacement of the holder 17 and the swingable swash plate 19 about the pivots 16 varies. More specifically, when the control piston 33 has moved leftwardly as viewed in FIG. 1, the holder 17 and the swingable swash plate 29 are swung clockwisely in correspondence to the movement of the control piston 33, resulting in a smaller sliding stroke of each working piston 13. On the other hand, when the control piston 33 has moved rightwardly, the sleeve 15 also moves rightwardly under the influence of a working pressure on the working pistons 13. Correspondingly, the holder 17 and the swingable swash plate 19 are swung conterclockwisely as viewed in FIG. 1 resulting in a larger operating stroke of the working pistons 13.

A discharge chamber 42 is defined between the cylinder head 4 and the end plate 11, and a discharge passage 43 provided in the cylinder head 4 is connected to the discharge chamber 42. An intake chamber 44 is defined between the cylinder head 4 and the end plate 11 to angularly surround the discharge chamber 42 and is connected to the working chamber 5 through a communication passage 45 made in the cylinder block 3. Further, an intake passage (not shown) made in a wall of the casing body 2 is connected to the working chamber 5.

The end plate 11 is provided with plural discharge ports 46 which permits the communication of the discharge chamber 42 with the pressure chambers 12. A discharge valve 47 is mounted in each discharge port 46 and adapted to open the discharge port 46 when the working piston 13 is in a compressing operation. The end plate 11 is further provided with plural intake ports 48 which permits the communication of the intake chamber 44 with the pressure chambers 12. An intake valve 49 is mounted in each intake port 48 and adapted to open the intake port 48 when the working piston 13 is in an intake operation.

As the plurality of pistons 13 reciprocate in sequence, in viewing the intake stroke of a particular piston, the refrigerant is passed from the intake passage through the working chamber 5 and the communication passage 45 into the intake chamber 44 and then, it opens the corresponding intake valve 49 and is drawn into the respective pressure chamber 12. In the compressing stroke of the piston, the compressed refrigerant in the respective pressure chamber 12 opens the corresponding discharge valve 47 and is passed under pressure from the discharge chamber 43 into the discharge passage 43.

A control valve 51 is disposed in the end wall $2_1$ of the casing body 21 in the casing 1 for providing the pressure control for the control pressure chamber 34. The control value 51 is interposed between a discharge passage (not shown) leading to the discharge chamber 44 and an intake passage 52 leading to the intake chamber 44 through the working chamber 4 and through the communication passage 45, as well as a control passage 53 leading to the control pressure chamber 34. The control valve 51 is adapted to increase the pressure in the control pressure chamber 34 in response to the reduction of the pressure in the intake chamber 44 when the cooling load of the air conditioner is reduced, whereby the control piston 33 is moved leftwardly as viewed in FIG. 1, causing the holder 17 and the swingable swash plate to swing in a righting direction, resulting in a smaller operation stroke of each working piston 13, on the one hand, and to reduce the pressure in the control pressure chamber 34 in response to the increase of the pressure in the intake chamber 44 when such cooling load is increased, whereby the control piston 33 is moved rightwardly as viewed in FIG. 1 causing the holder 17 and the swingable swash plate 19 to swing counterclockwisely as viewed in FIG. 1, resulting in a larger operation stroke of each working piston 13, on the other hand.

In order to detect the operation stroke of each working piston 13, stroke detecting means 57 is disposed in the compressor C and comprises an interlocking member 55 supported at its middle portion on the casing 1 through a support shaft 54 parallel to the axis L2 and perpendicular to the axis L1 of the driving shaft 6 and connected at one end thereof to the control piston 33, and a position detector 56 disposed in the casing to detect the position of the other end of the interlocking member 55.

Figure 2:
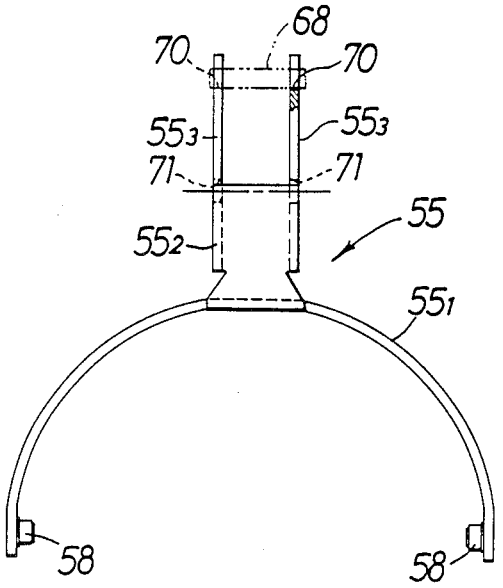

As shown in FIG. 2 the interlocking member 55 is comprised of a semicircular portion $55_1$ having a radius slightly larger than that of an outer peripheral surface of the control piston 33, a connecting plate portion $55_2$ linked to a circumferentially central portion of the semicircular portion $55_1$, and a pair of opposed plate portions $55_3$ and $55_3$ perpendicularly linked to the connecting plate portion $55_2$ in an opposed relation. Inwardly projecting pins 58 are mounted on circumferentially opposite ends of the semicircular portion $55_1$, respectively and are engaged in annular grooves 59 provided in an outer surface of the control piston 33, respectively, whereby one end of the interlocking member 55 is connected to the control piston 33. Insert holes 71 are made in the opposed plate portions $55_3$ and $55_3$, respectively, and the support shaft 54 inserted through the insert holes 71, 71 is supported on the casing 1, whereby the middle portion of the interlocking member 55 is supported on the casing 1.

The position detector 56 is a differential transformer and comprises a basically cylindrical housing 60, a bobbin 61 basically cylindrically formed of a synthetic resin and fixed within the housing 60, secondary coils 62, 62 wound around an outer periphery of the bobbin 61 at two axially spaced-apart places, respectively, primary coils 63, 63 wound around outer peripheries of the secondary coils 62, 62, respectively, a core axially movably received in the bobbin 61, and a spring 65 interposed between the bobbin 61 and the core 64 for biasing the core 64 axially outwardly (rightwardly as viewed in FIG. 1). The housing 60 is fixed to the outer surface of the casing body 2 in the casing 1 in a parallel relation to the axis L1 of the driving shaft 6.

An opening 66 is provided in the casing body 2 at its portion corresponding to the position detector 56, and an opening 67 is also provided in the housing 60 of the position detector 56 at its portion corresponding to the opening 66. The other end of the interlocking member 55 supported on the casing 1 by the support shaft 54, i.e., the opposed plate positions $55_3$, $55_3$ are inserted through the openings 66 and 67 into the housing 60 and disposed on opposite sides of the bobbin 61. A connecting pin 68 is fixed to an outer end of the core 64 to extend along one diametrical line and has its opposite ends projecting outwardly through an elongated hole 69 provided in the bobbin 61. The opposed plate portions $55_3$, $55_3$ are provided at leading ends thereof with substantially U-shaped engagement portions 70, 70 with which opposed ends of the connecting pin 68 are engaged, respectively.

With such stroke detecting means 57, when the axial movement of the control piston 33 causes the interlocking member 55 to be swung about the support shaft 54, the core 64 is axially displaced with the change in position of the other end of the interlocking member 55, i.e., the leading ends of the opposed plate portions $55_3$, $55_3$. In a condition of a rectangular-wave input voltage having a given frequency and a given amplitude being applied to the primary coils 63, 63, the difference in AC voltage developed between the secondary coils 62, 62 is varied depending upon the axial displacement of the core 64. Therefore, it is possible to detect the axial position of the core 64, i.e., the axial position of the control piston 33 through the interlocking member 55.

The operation of this embodiment will be described below. When the control piston 33 is moved axially, the sleeve 15 is moved axially of the driving shaft 6 with the aid of the control plate 37. Correspondingly, the holder 17 and the swingable swash plate 19 are swung about the pivots 16, resulting in a varied operation stroke of each working piston 13. Thus, the operation stroke of the working pistons 13 corresponding to the axial position of the control piston 33 can be detected by the position detector 56, because the interlocking member 55 is also swung about the support shaft 54 as the control piston 33 is moved.

Moreover, the position detector 56 detects the position of the other end of the interlocking member 55 corresponding to the axial position of the control piston 33 and is capable of detecting the axial position of the control piston 33, i.e., the operation stroke of the working pistons 13, even before the variable displacement type compressor C is operated. Therefore, the number of revolutions of the engine can be set, and the amount of fuel supplied to the engine sufficient to maintain the number of revolutions can be also set, both at the time when the operation of the compressor C is started in a region of lower revolution of the engine connected to the driving shaft 6.

For the position detector 56, it is desirable in improving the detection accuracy that the core 64 is largely displaced as compared with the axial displacement of the control piston 33, on the one hand, and it is desirable in the layout of the position detector 56 that the amount of such displacement is smaller, on the other hand. However, it is possible to provide a design with a balance of such conflicting demands taken by selection of the disposing position for the support shaft 54 supporting the interlocking member 55.

Further, an angular ball bearing 36 is interposed between the control plate 37 and the control piston 33. Therefore, it is avoided to the utmost that the rotational motions of the sleeve 15 and the control plate 37 influence the control piston 33, thereby avoiding the rotational operation of the control piston 33 to the utmost. Thus, it is possible to prevent an unreasonable force from being applied to one end of the interlocking member 55.

In addition, it is possible to replace and repair the parts of the position detector 56 without opening of the casing 1, because the position detector 56 is disposed outside the casing 1.

Figure 3:
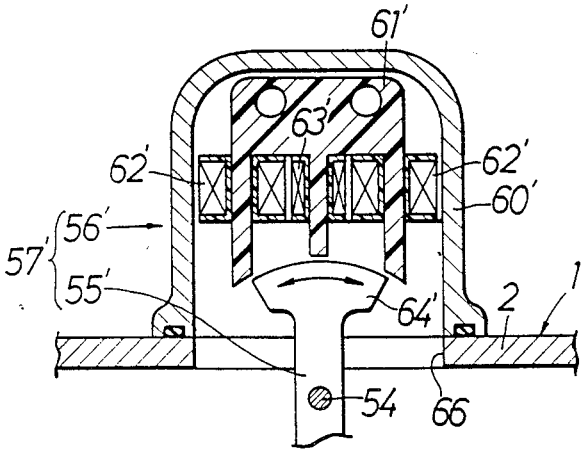
FIG. 3 is a side view in longitudinal section of another embodiment of the position detector of the present invention.

FIG. 3 illustrates another embodiment of the present invention, wherein portions corresponding to those in the previous embodiment are designated by the same reference characters.

Stroke detecting means 57' is comprised of an interlocking member 55' connected at one end thereof to the control piston 33 (FIG. 1) and swingably supported at its middle portion on the casing 1 through the support shaft 54, and a position detector 56' disposed on the casing 1 to detect the position of the other end of the interlocking member 55'.

The position detector 56' is a differential transformer and comprises a housing 60' fixed to an outer surface of the casing body 2 in the casing 1, a bobbin 61' fixed in the housing 60', secondary coils 62', 62' wound around the bobbin 61' at two places spaced apart axially of the driving shaft 6 (see FIG. 1), i.e., laterally as viewed in FIG. 3, a primary coil 63' wound around the bobbin 61' at a place intermediate between the secondary coils 62', 62', and a core 64' integrally provided on the other end of the interlocking member 55' protruded through an opening 66 in the casing body 2 into the housing 60'. The core 64' is disposed in an opposed relation to the secondary coils 62', 62' and the primary coil 63'.

With such stroke detecting means 57', the difference in AC voltage developed between the secondary coils 62', 62' is varied depending upon the swinging movement of the interlocking member 55' about the support shaft 54. Therefore, it is possible to detect the position of the other end of the interlocking member 55', and to detect the operation stroke of the working pistons 13 (see FIG. 1), even before starting of the operation of the compressor C. Thus, it is possible to provide an effect similar to that in the previous embodiment.

The position detector 56, 56' has been shown and described as a transformer in each of the above embodiments, but may be any type of detector which is capable of detecting the position of the other end of the interlocking member 55, 55'. For example, a magnetic resistor element, a slide resistor or the like can be used in place of the differential transformer to compose a position detector.

As discussed above, according to the first feature of the present invention, the stroke detecting means comprises an interlocking member supported at its middle portion on the casing through a support shaft having an axis, perpendicular to the axis of the driving shaft and connected at one end thereof to the control piston, and a position detector disposed on the casing to detect the position of the other end of the interlocking member. Therefore, it is possible to detect the operation stroke even before starting of the operation of the compressor, thereby providing a design which satisfies requirements for the detection accuracy and the layout of the position detector.

According to the second feature of the present invention, the control piston is relatively rotatably connected to the sleeve to inhibit the transmission of the rotating movement of the sleeve about the axis of the driving shaft. Therefore, it is possible to avoid the rotating operation of the control piston, thereby preventing an unreasonable force from being applied to the interlocking member.

Further, according to the third feature of the present invention, the position detector is disposed outside the casing and hence, replacement and repair the parts of the position detector is facilitated.

It is readily apparent that the above-described has the advantage of wide commercial utility. It should be understood that the specific form of the invention hereinabove described is intended to be representative only, as certain modifications within the scope of these teachings will be apparent to those skilled in the art.

Accordingly, reference should be made to the following claims in determining the full scope of the invention.

What is claimed is:

1. A variable displacement type compressor comprising: a casing having a working chamber internally defined therein and a plurality of cylinder bores provided therein and opened to face to said working chamber; a driving shaft rotatably carried in the casing with the cylinder bores disposed around the driving shaft; a working piston slidably received in each of the cylinder bores; a sleeve axially slidably fitted over the driving shaft within the working chamber; a holder carried on the sleeve for swinging movement about an axis perpendicular to an axis of the driving shaft and connected to the driving shaft; a swingable swash plate carried on said holder and connected to said working pistons through connecting rods; a control piston connected to the sleeve and slidably received in the casing so as to vary the angle of inclination of said holder and said swingable swash plate to vary the operation stroke of the working pistons; and stroke detecting means for detecting the operation stroke of the working pistons, wherein said stroke detecting means comprises an interlocking member supported at a middle portion on the casing through a support shaft having an axis perpendicular to the axis of the driving shaft and said interlocking member connected at one end thereof to the control piston, and a position detector disposed on the casing to detect the position of the other end of said interlocking member.

2. A variable displacement type compressor according to claim 1, wherein said control piston is relatively rotatably connected to the sleeve to inhibit the transmission of the rotating movement of the sleeve about the axis of the driving shaft.

3. A variable displacement type compressor according to claim 1, wherein said position detector is disposed outside the casing.

* * * * *